United States Patent [19]

Kiefer

[11] 4,391,330

[45] Jul. 5, 1983

[54] APPARATUS AND METHOD FOR INSTALLING AND ENERGIZING SUBMERGIBLE PUMP IN UNDERWATER WELL

[75] Inventor: Karl Kiefer, Bartlesville, Okla.

[73] Assignee: TRW Inc., Cleveland, Ohio

[21] Appl. No.: 298,503

[22] Filed: Sep. 1, 1981

Related U.S. Application Data

[62] Division of Ser. No. 78,907, Sep. 25, 1979, Pat. No. 4,304,452.

[51] Int. Cl.[3] ..... E21B 33/043

[52] U.S. Cl. ..... 166/341; 166/65 R; 166/378

[58] Field of Search ..... 166/378, 379, 385, 60, 166/65, 341

[56] References Cited

U.S. PATENT DOCUMENTS

| | | | |
|---|---|---|---|
| 3,638,732 | 2/1972 | Huntsinger | 166/379 |
| 3,781,456 | 12/1973 | Knowles | 166/65 R |
| 3,976,347 | 8/1976 | Cooke | 166/65 R |
| 4,003,428 | 1/1977 | Zehren | 166/65 R |

FOREIGN PATENT DOCUMENTS 1526610 7/1978 United Kingdom .

*Primary Examiner*—William F. Pate, III
*Attorney, Agent, or Firm*—Shapiro and Shapiro

[57] ABSTRACT

A submergible pump is suspended from a suspension head and lowered into an underwater well. The pump is lowered through the bore of a spool at the wellhead, and the suspension head is supported on a shoulder in the spool. A contact region of the bore has a first set of contacts engageable with corresponding contacts of a second set on the suspension head. Well fluid and other contaminants are flushed from the contact region by a cleaning fluid dispensed from passages in the suspension head. A dielectric fluid is then similarly dispensed to the contact region. Locking lugs lock the suspension head in the spool, and seals exclude well fluid from the contact region. The cleaning fluid and the dielectric fluid may be supplied from a remote source, such as a vehicle employed in lowering the pump and suspension head.

5 Claims, 3 Drawing Figures

APPARATUS AND METHOD FOR INSTALLING AND ENERGIZING SUBMERGIBLE PUMP IN UNDERWATER WELL

This is a divisional application of U.S. Ser. No. 78,907, filed Sept. 25, 1979 now U.S. Pat. No. 4,304,452.

BACKGROUND OF THE INVENTION

This invention relates to apparatus and methods for installing and energizing submergible pumps in underwater wells.

Increasing demand and price of petroleum products have stimulated great interest in subsea exploration for and production of oil and gas. Until recently these activities have centered around offshore platforms, but with the need for operating at greater depths and with greater flexibility, subsea wells remote from or even independent of offshore platforms have become more attractive. Such subsea wells may have production trees that are remotely or automatically controlled, with production tubing extending along the ocean floor to a remote depot.

Installing and energizing submergible pumps in such subsea wells involve difficult problems. Running and pulling operations are expensive and should be minimized and simplified to the extent possible.

When submergible pumps are employed in onshore wells, the pump motor may be energized from a cable that extends through a packing at the wellhead. In subsea wells such energization of the pump is not practical because of the difficulty of providing adequate seals around the cable extending from the wellhead. The avoidance of oil spills has very high priority.

Accordingly, attempts have been made to suspend the submergible pump in the well from a suspension head that seats in the wellhead apparatus and that has an electrical connector part engaging a mating electrical connector part on the wellhead apparatus to supply electrical energy to the pump. In theory, this concept is highly advantageous, since it is unnecessary to run a power cable through seals or packings that must be opened to install or remove the pump. In practice, however, the technique leaves much to be desired. Providing good, long-lasting electrical contacts capable of carrying heavy currents in an environment contaminated by well fluid is a problem not easily solved.

Accordingly, an object of the present invention is to provide an improved apparatus and method for installing and energizing submergible pumps in underwater wells.

Another object of the invention is to provide improved electrical connectors.

A further object of the invention is to provide improved apparatus and methods for making good, long-lasting, electrical contacts at a contact region that is contaminated.

Still another object of the invention is to provide improved apparatus and methods for cleansing, insulating, and sealing an electrical contact region, particularly in an underwater wellhead.

Briefly stated, in one of the broad aspects of the invention, apparatus for underwater electrical connections and the like, comprises a first member having a space therein with first electrical contact means at a contact region of the space, a second member adapted to be received in said space and having second electrical contact means adapted to engage the first contact means, means for supplying fluid to the contact region to cleanse the region, and means for exhausting the fluid from the region.

In another of the broad aspects of the invention, underwater electrical connector apparatus and the like comprises a first member having a bore therein with a first set of contacts at a contact region, a second member adapted to enter the bore and having a second set of contacts adapted to engage corresponding contacts of the first set, and means for locking the members together with the contacts engaged, at least some of the contacts being annular and being disposed about the axis of the bore.

In a further broad aspect of the invention, a method of installing and energizing an electric submergible pump in an underwater well comprises providing at an underwater wellhead a spool having a bore aligned with the well and having a first set of electrical contacts at a contact region of the bore, suspending the pump from a suspension head having a second set of contacts adapted to engage corresponding contacts of the first, lowering the suspension head and the pump into the bore with the pump passing through the bore into the well, and with the contacts of the second set positioned for engagement with the corresponding contacts of the first set, passing a cleaning fluid through the contact region of the bore, fixing the suspension head in the bore, and sealing the contact region of the bore so as to exclude well fluid therefrom.

BRIEF DESCRIPTION OF THE DRAWINGS

The invention will be further described in conjunction with the accompanying drawings, which illustrate preferred and exemplary embodiments, and wherein.

DETAILED DESCRIPTION OF THE PREFERRED EMBODIMENTS

Figure 1:
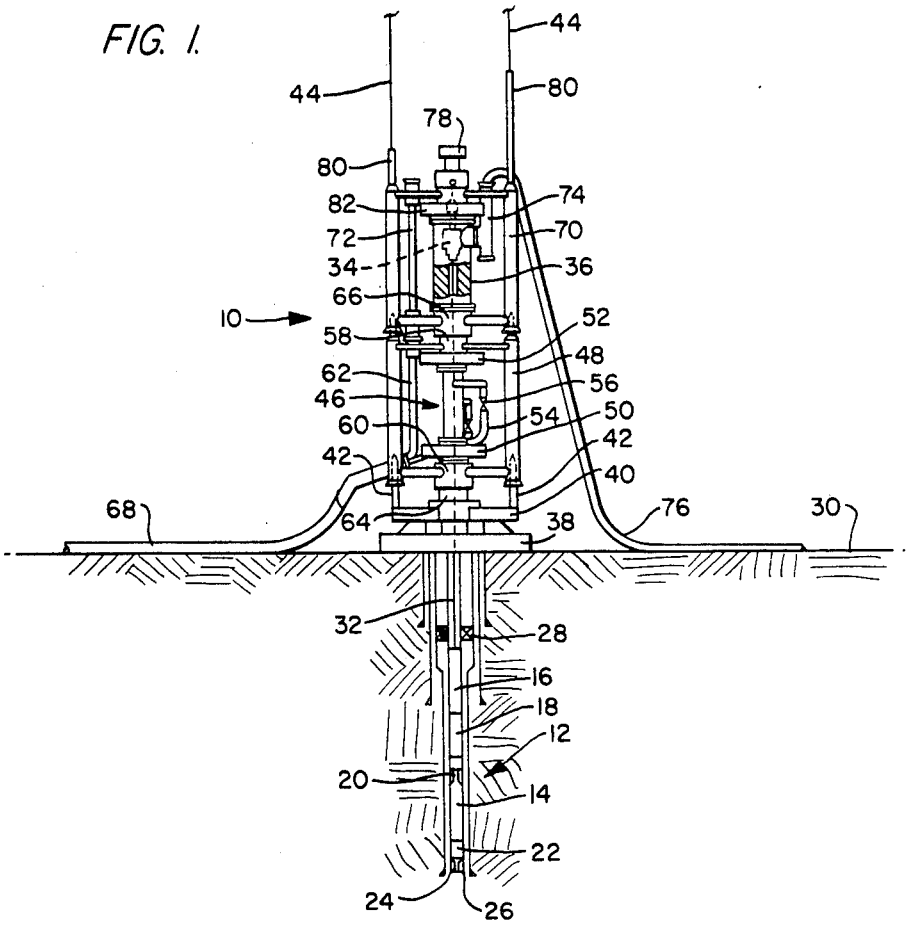
FIG. 1 is a somewhat diagrammatic elevation view of a subsea well, including wellhead apparatus.

As shown in FIG. 1, the invention may be employed in underwater wellhead apparatus 10 associated with an underwater well 12. The well itself may be conventional and includes the usual casing and pipe strings. Suspended in the well (in a manner to be described) is a submergible pump assembly, which may include a conventional submergible pump 14, an electric motor 16 for driving the pump, a protector 18, a pack-off and lock 20 (isolating the inlet side of the pump from the discharge side), a hydraulic safety valve 22, and a valve actuator 24 for a mechanical isolation valve 26 at the bottom of an inner pipe string of the well. A vented annulus packer 28 may be employed between coaxial pipes as shown. The casing and pipe strings are shown diagrammatically and may be extended to the desired depth below the mud line or floor 30 of the body of water above the well. The pump and associated components may be suspended by a cable 32 (or pipe string) attached at its upper end to a suspension head 34 seated in a spool 36 of the wellhead apparatus. The wellhead apparatus may also comprise a temporary guide base 38, a guide base 40 with guide posts 42, guide cables 44 leading from the guide posts to buoys or a platform, and a production tree 46 including a guide frame 48, a master valve 50, a full opening valve 52, flow lines 54, a wing valve 56, hydraulic connectors 58 and 60, and a hydraulic interconnect 62. Hydraulic connector 60 mates with a hydraulic connector 64 on the guide base, while hydraulic connector 58 mates with a hydraulic connector 66 at the bottom of spool 36. Elements of guide frame 48 mate with corresponding guide posts 42. Production tubing 68 leads from the production tree 46 to a remote platform or depot, for example.

Spool 36 is mounted on a guide frame 70, elements of which mate with elements of guide frame 48. A hydraulic interconnect 72 mates with the corresponding hydraulic interconnect 62 of the production tree. The spool has an associated electrical power interconnect 74 which receives a power cable 76 leading from an electrical power source. A corrosion cap 78 is provided at the top of the spool. Reentry guide posts 80 extend upwardly from guide frame 70, and guide cables 44 pass through the guide frames and guide posts in sequence. A full opening valve 82 may be provided at the top of spool 36 below the corrosion cap 78.

Figure 2:
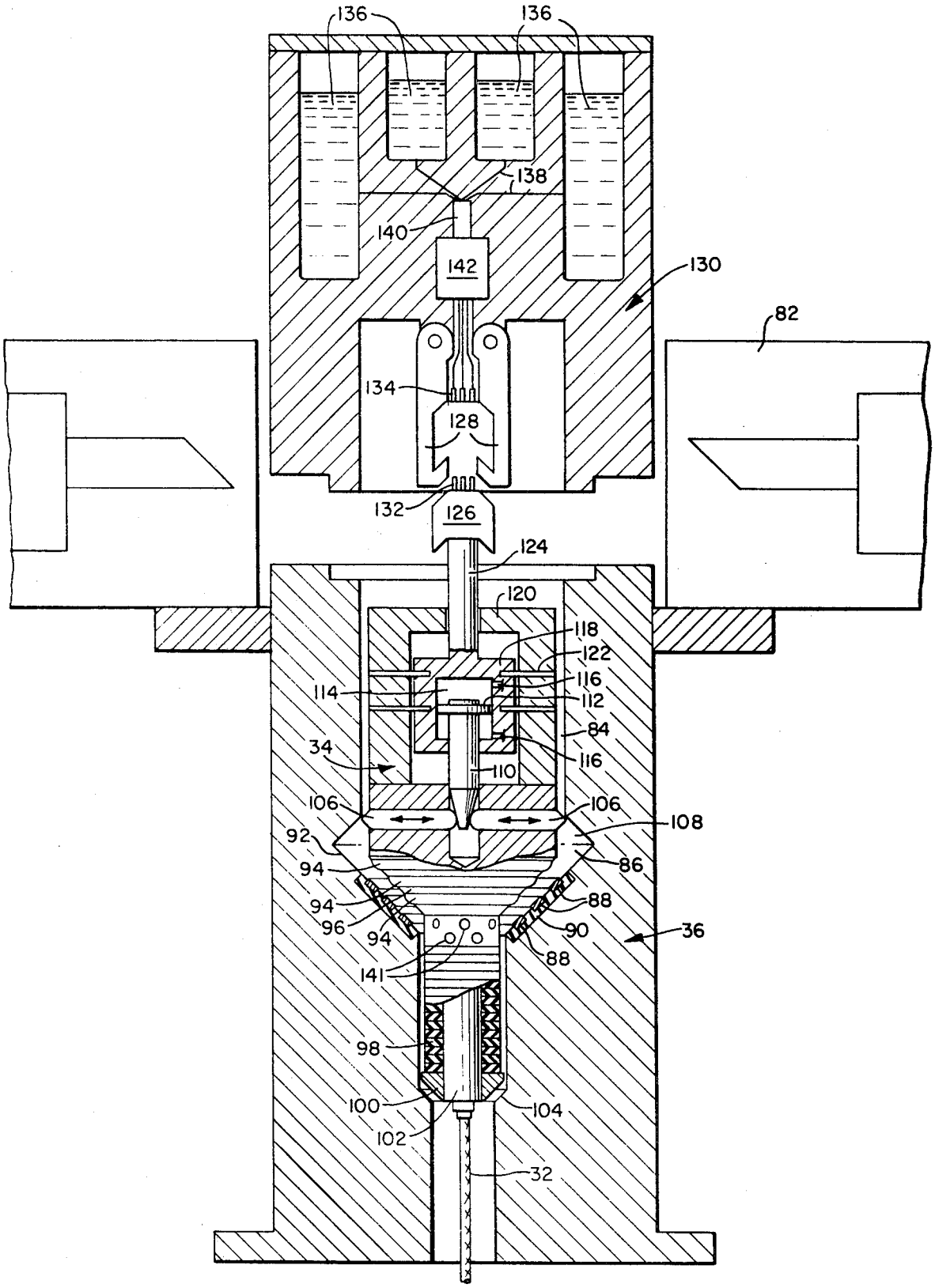
FIG. 2 is a somewhat diagrammatic vertical sectional view illustrating details of apparatus in accordance with the invention.

As shown in greater detail in FIG. 2, spool 36 has a longitudinal bore therein that is aligned with the axis of the wellhead apparatus. The bore has a contact region 86 at which a first set of contacts 88 are located. These contacts are preferably annular and supported on insulation 90 in spaced relationship along a conical surface 92 coaxial with the bore 84. Conductors (not shown) extend from each of contacts 88 to the electrical interconnect 74 (FIG. 1). Suspension head 34 has a second set of contacts 94 disposed in spaced relationship along another conical surface 96 that is also coaxial with the bore 84. Contacts 94 are suitably insulated from one another and are preferably annular also, although they may have raised contact regions (not shown) to assist in providing electrical connection with corresponding contacts 88.

The lower end of the suspension head has a packoff 98 which may comprise a stack of compressible rings or "doughnuts" that expand horizontally when compressed vertically. At the bottom of the stack is a retainer ring 100 slidable along a post 102 fixed to the suspension head. Ring 100 is adapted to seat on a mating shoulder 104 of the bore 84.

The suspension head has a plurality of radially movable lugs or dogs 106 that may be hydraulically actuated to move outwardly into engagement with portions of a recess or circumferential groove 108 in the spool 36. The lugs and the recess portions have mating cam surfaces that cause the suspension head to move downwardly when the lugs are moved outwardly, thereby compressing the compressible rings of the pack-off (with ring 100 seated on shoulder 104), urging contacts 94 into engagement with corresponding contacts 88, and locking spool 36 (sometimes referred to hereinafter as a "first member") together with suspension head 34 (sometimes referred to hereinafter as a "second member").

Lugs 106 may be moved outwardly by the tapered ends of a portion rod 110 having a piston 112 supported for reciprocation in the cylinder 114 provided with hydraulic lines 116. When the piston is driven downwardly, lugs 106 are cammed outwardly by the tapered lower end of piston rod 110. When the piston moves upwardly, the lugs are free to move inwardly. The lugs may be locked outwardly by engagement with an untapered or reduced taper portion of piston rod 110, so that members 34 and 36 may be locked together even when the hydraulic pressure in cylinder 114 is relieved.

In the form of the invention shown, cylinder 114 is formed in an inner body 118 supported in a hollow outer body 120. These bodies are normally connected together by shear pins 122. The inner body has an extension neck 124 provided with a knob 126 for engaging jaws 128 of a running tool 130. In the event that the lugs 106 are locked outwardly and the piston 122 cannot be hydraulically moved upwardly, a sufficient upward pull on knob 126 will break the shear pins 122 and move inner body 118 upwardly in outer body 120, thereby to move the piston 112 and piston rod 110 upwardly to release lugs 106. If corrosion locks the lugs 106 outwardly, the pull on knob 126 may be made sufficient to shear off the lugs.

The hydraulic lines 116 from cylinder 114 may pass through neck 124 to a hydraulic connector part 132 engageable with a mating hydraulic connector part 134 on the running tool 130. The running tool, which may serve as the vehicle for installing and removing the pump in the well, may have a plurality of fluid reservoirs 136 for selectively supplying fluid to connector part 134 via hydraulic lines 138 and control valves 140. Fluid from reservoirs 136 passes through appropriate elements of connector parts 132 and 134 and corresponding passages in the suspension head (not shown), which may include hydraulic connectors between inner body 118 and outer body 120, to a series of dispensing ports 141 spaced about the lower portion of the suspension head above pack-off 98. The running tool may include a hydraulic cylinder 142 for actuating the jaws 128 in a well known conventional manner. Fluid reservoirs 136 may be charged accumulators pressurized with an appropriate gas, for example. Pressurization may be accomplished prior to lowering the running tool from a working platform, for example.

The running tool may be lowered by means of a conventional guide frame (not shown) on cables 44 (FIG. 1). For simplicity of illustration, the guide frame and lowering cable or cables are not shown. The running tool may also be lowered by cable through a conventional marine riser or in an outer container or vehicle, such as a lubricator. Although the fluid reservoirs are shown as part of the running tool (sometimes referred to as a "third member" hereinafter), fluid may be supplied from a source remote from the running tool.

To install a submergible pump in an underwater well in accordance with the invention, the running tool 130 is coupled to the suspension head 34, and the suspension head and the pump assembly suspended therefrom are lowered into spool 36, with the pump assembly passing through the bore of the spool and into the well, as shown in FIG. 1. The length of cable 32 will be sufficient to position the pump at the desired location in the well. When the suspension head enters bore 84, ring 100 will seat on shoulder 104 of the bore, preferably just before the contacts of the suspension head engage the contacts of spool 36. One or more fluids may then be dispensed from reservoirs 136, with control valves 140 being actuated remotely via connections to the running tool 130. These fluids may include a cleansing fluid, such as a conventional diffractant, for flushing well fluid and other contaminants from the contact region 86. The dispensed fluid may be exhausted through the production tubing 68 (FIG. 1), passing ring 100, which may have grooves for this purpose. Another fluid which may be employed for flushing the contact region is ordinary sea water, which may be supplied from a reservoir 136 in the running tool or pumped downwardly to the running tool from a working platform. Any other fluids which are conventionally used to promote a clean electrical contact region may be employed. After cleansing of the contact region, it is preferred to dispense (from a reservoir 136 or otherwise) a dielectric fluid (such as a grease) into the contact region. If desired, this may be accomplished after the pack-off 98 is rendered effective, so that the dielectric fluid cannot escape from the contact region. The dielectric fluid may be dispensed during or just before the actuation of the locking lugs 106, so that the contacts are forced into engagement through the dielectric fluid. The full opening valve 82 may then be closed to seal the upper end of bore 84 and to maintain the dielectric fluid in the bore. In FIG. 1 the upward extension of the neck at the top of the suspension head 34 is exaggerated, and in practice the neck does not interfere with the closure of valve 82.

Figure 3:
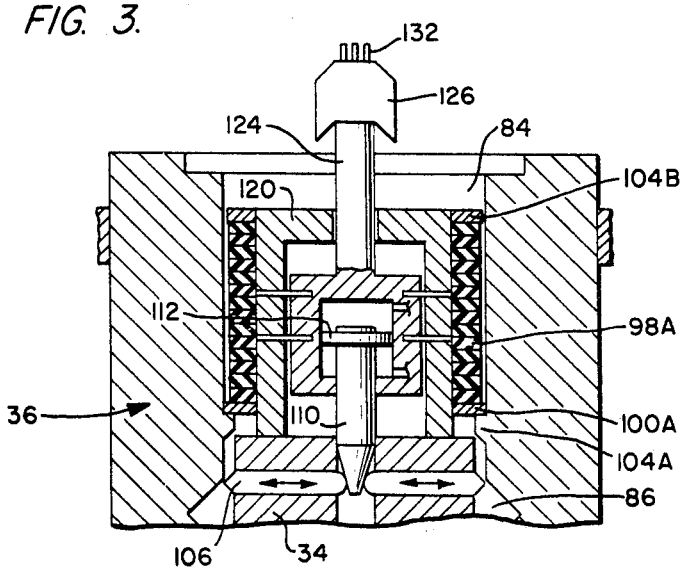
FIG. 3 is a fragmentary, somewhat diagrammatic vertical sectional view of a modification.

FIG. 3 illustrates a modification in which the suspension head has an upper pack-off 98A comprising a stack of compressible rings supported at the bottom on a retainer ring 100A adapted to seat on a shoulder 104A. Ring 100A is free to move along the suspension head. An upper retainer ring 104B is fixed to the suspension head. The compressible rings of the pack-off are compressed between rings 104A and 104B when lugs 106 move outwardly and force the suspension head downwardly. A seal is thus provided at the upper end of bore 84 without the need for the full opening valve 82. By this arrangement it is simple to leave the contact region 86 sufficiently pressurized with dielectric fluid so that any leak that occurs will be a leak of the dielectric fluid outwardly of the bore, rather than a leak of well fluid or sea water into the contact region.

While several preferred embodiments of the invention have been shown and described, it will be apparent to those skilled in the art that changes can be made in these embodiments without departing from the principles and spirit of the invention, the scope of which is defined in the appended claims.

What is claimed:

1. A method of installing and energizing an electric submergible pump in an underwater well, comprising providing at an underwater wellhead a spool having a bore aligned with the well and having a first set of electrical contacts at a contact region of the bore, suspending the pump from a suspension head having a second set of contacts adapted to engage corresponding contacts of the first set, lowering the suspension head and the pump into the bore with the pump passing through the bore into the well, and with the contacts of the second set positioned for engagement with the corresponding contacts of the first set, introducing a cleaning fluid into the contact region of the bore through the suspension head, exhausting the cleaning fluid from the contact region through the bore in the spool, fixing the suspension head in the bore, and sealing the contact region of the bore so as to exclude well fluid therefrom.

2. A method in accordance with claim 1, wherein prior to said sealing a dielectric fluid is introduced to the contact region of the bore through the suspension head.

3. A method in accordance with claim 2, wherein the first and second sets of contacts are brought into engagement after introduction of the dielectric fluid.

4. In a method of installing and energizing an electric submergible pump in an underwater well which comprises providing at an underwater wellhead a spool having a bore aligned with the well and having a first set of electrical contacts at a contact region of the bore, suspending the pump from a suspension head having a second set of contacts adapted to engage corresponding contacts of the first set, lowering the suspension head and the pump into the bore with the pump passing through the bore into the well and with the contacts of the second set positioned for engagement with the corresponding contacts of the first set, fixing the suspension head in the bore, and sealing the contact region of the bore so as to exclude well fluid therefrom, the steps including introducing a cleaning fluid into the contact region after the contacts of the second set have been positioned as aforesaid, exhausting the cleaning fluid from the contact region, and then introducing a dielectric fluid into the contact region for retention therein.

5. A method in accordance with claim 4, wherein the first and second set of contacts are brought into engagement after introduction of the dielectric fluid.

* * * * *